United States Patent [19]

Schwoebel et al.

[11] Patent Number: 4,978,172

[45] Date of Patent: Dec. 18, 1990

[54] GOB METHANE DRAINAGE SYSTEM

[75] Inventors: Jeffrey J. Schwoebel, South Jordan; Terry L. Logan, Park City, both of Utah

[73] Assignee: Resource Enterprises, Inc., Salt Lake City, Utah

[21] Appl. No.: 426,848

[22] Filed: Oct. 26, 1989

[51] Int. Cl.[5] ..... E21B 43/00; E21C 41/18

[52] U.S. Cl. ..... 299/12; 166/50; 166/369

[58] Field of Search ..... 299/10, 12; 166/50, 166/369, 370; 175/61, 62

[56] References Cited

U.S. PATENT DOCUMENTS

| | | | |
|---|---|---|---|
| 3,934,649 | 1/1976 | Pasini, III et al. | 299/12 X |
| 4,245,699 | 1/1981 | Steeman | 299/12 X |
| 4,303,274 | 12/1981 | Thakur | 299/12 |
| 4,305,464 | 12/1981 | Masszi | 166/370 |
| 4,807,704 | 2/1989 | Hsu et al. | 175/61 X |
| 4,858,689 | 8/1989 | Logan | 299/4 X |

FOREIGN PATENT DOCUMENTS

| | | | |
|---|---|---|---|
| 1402678 | 6/1988 | U.S.S.R. | 299/12 |

*Primary Examiner*—George A. Suchfield
*Attorney, Agent, or Firm*—M. Reid Russell

[57] ABSTRACT

A system for recovering methane gas from a coal seam and rock strata and other coal seams above a coal seam being mined or as has been previously mined. The system involves directionally drilling one or more degas holes from a surface location that curve to extend above and essentially parallel, near parallel or slanted to a coal seam to be mined or as has been previously mined. The degas hole is spaced an appropriate vertical distance above the coal seam, usually twenty (20) to two hundred (200) feet, depending on the mining technique being employed and rock strata characteristics. The degas hole is to draw methane gas under vacuum or pressure differential from the gob that is created when the overburden is collapsed. Multiple degas holes can be formed from the same surface location to run parallel to, across and even at an angle to a coal seam.

6 Claims, 2 Drawing Sheets

GOB METHANE DRAINAGE SYSTEM

BACKGROUND OF THE INVENTION

1. Field of the Invention

The invention relates to drilling processes for recovering methane from coal mine gob areas through degas holes.

2. Prior Art

The hazards associated with methane presence in a breathable air atmosphere in coal mines are well known. Such methane is generally accepted as being either in the coal itself or surrounding strata. Such surrounding strata containing methane can be above or below the coal seam and may or may not communicate with the mine through cracks or fractures, either naturally occurring or as are created in a mining process.

Until recent years methane presence has been viewed solely as a hazard and has been removed at the coal seam face or through horizontal holes drilled into the seam face for venting. Recently, vertical degas holes drilled from the surface to the seam or just above it have been utilized to degas coal mines, with the collected gas being vented or saved and transported for commercial use. Where longwall mining is practiced, such vertical wells are placed above the seam to be minded. As mining advances the ceiling is controlled and allowed to fall in as the roof supports are advanced. The vertical hole is placed to draw from both the methane released from the coal seam being mined and the adjacent strata that caves or fractures into the extracted mine panel. Experience has suggested that such vertical holes be no closer than the width at the seam end and near the center line but may be offset to maintain integrity. The practicality and feasibility of this drilling is, of course, dependent upon the ground conditions above the coal seam and the seam depth.

The present invention, like an earlier patent application of one of the present inventors, in a "Coal Gasification Well Drilling Process", U.S. Ser.No. 179,663 now U.S. Pat. No. 4,858,689, employs directional drilling techniques. With the present process, such directional drilling techniques are employed to drill one or more degas holes to curve so as to be parallel, near parallel or slanted and spaced an optimum distance above a coal seam to be subjected to the effects of longwall or retreat mining. Directional drilling of injection and production well bores for coal gasification processes are shown in the Collins U.S. Pat. Nos. No. 4,422,505, and the Garkusha, et al. U.S. Pat. No. 4,573,531. The arrangement, purpose and operation of the processes disclosed in these patents are accordingly unlike the present invention. Similarly distinct from the present invention, the Zakiewicz U.S. Pat. No. 4,249,775, is directed to a method for mining sulphur.

The present invention, unlike such earlier minerals and hydrocarbon recovery systems, utilizes directional drilling techniques for forming one or more degas holes located in advance of mining above and to curve to be essentially parallel, near parallel or slanted and spaced a certain distance above a coal seam to be mined. Similarly, a directionally drilled degas borehole may be drilled subsequent to mining above abandoned mine workings to recover methane gas. The formed hole is for recovery of methane gas from the seam front and the adjacent rock strata that is in communication with the gob area of the coal mine.

SUMMARY OF THE INVENTION

It is a principal object of the present invention to provide a method for methane extraction from a coal seam and adjacent rock strata that is either actively mined using longwall, room and pillar or conventional pillar extraction techniques or are inactive abandoned mine workings.

Another object is to provide a method for forming a degas hole by directional drilling techniques to extract methane from a subterranean coal seam that is either actively mined using longwall, room and pillar or conventional pillar extraction techniques or are inactive abandoned mine workings.

Another object is to provide a method for methane extraction involving directional drilling of one or more degas holes from a convenient surface location or locations that are curved to extend thereover, a spaced distance above and essentially parallel, near parallel or slanted to a coal seam to be either actively mined using longwall, room and pillar or conventional pillar extraction techniques or are inactive abandoned mine workings.

Still another object is to provide, from a surface location, or locations, a system of methane degassing holes to withdraw methane from a coal seam or seams being mined or have previously been mined that involves minimum drilling operations.

Still another object of the present invention is to provide a system of a degas hole or holes drilled from a surface location or locations for draining methane from and along an area of a coal seam or seams to be mined or have been previously mined, with methane drawn from the mined coal seam well as that released from the rock strata and any coal seams thereabove and therebelow that are rubblized or fractured as a result of the mining process.

In accordance with the above objects the present invention is a process for directionally drilling, from a convenient surface location or locations, a pattern of degas holes above a coal seam for withdrawing methane gas during and as a result of the mining process. Preferably from a single surface location, one or more degas holes are directionally drilled to a location that is above and laterally centered or offset to a coal seam panel. The drill string is then bent, by conventional directional drilling procedures and apparatus, to continue the degas hole to be parallel, near parallel or slanted and spaced a certain distance above the seam longitudinal center axis or offset to maintain borehole integrity as may be necessary. The degas spacing distance above the coal seam and lateral location is governed by the characteristics of the rock strata above that seam that it is anticipated will fracture or rubblize when the coal is extracted and allows the overlying strata to drop into the mined out area. Accordingly, with the single vertical degas hole methane is not released until after mining the coal seam under the vertical portion of the degas hole. Consequently, several vertical degas holes are often necessary to effectively degasify the area. In the present process, a single degas hole can be utilized to remove methane gas over a significant horizontal section of a coal seam being mined.

BRIEF DESCRIPTION OF THE DRAWINGS

These and other objects and features of the process of the present invention will become more apparent from the following description, which are provided for example and not limitation, in which the invention is described in detail in conjunction with the accompanying drawings, which are provided for example and not limitation.

DETAILED DESCRIPTION

In a practice of mining of a coal seam, methane gas is released from the seam itself and from adjacent rock strata. In such mining operations, the seam is often mined out completely for full resource recovery and subsequently allows the overlying strata to collapse. In that collapse, the rock strata will be disturbed upwards towards the surface and methane gas from this strata will migrate towards the mine workings. This methane gas must be quickly removed for mine safety and potentially is a commercially valuable resource for recovery. The present invention is in a process for quickly and economically removing such methane gas from gob areas that are a result of pillar/panel removal during mining operations.

Figure 1:
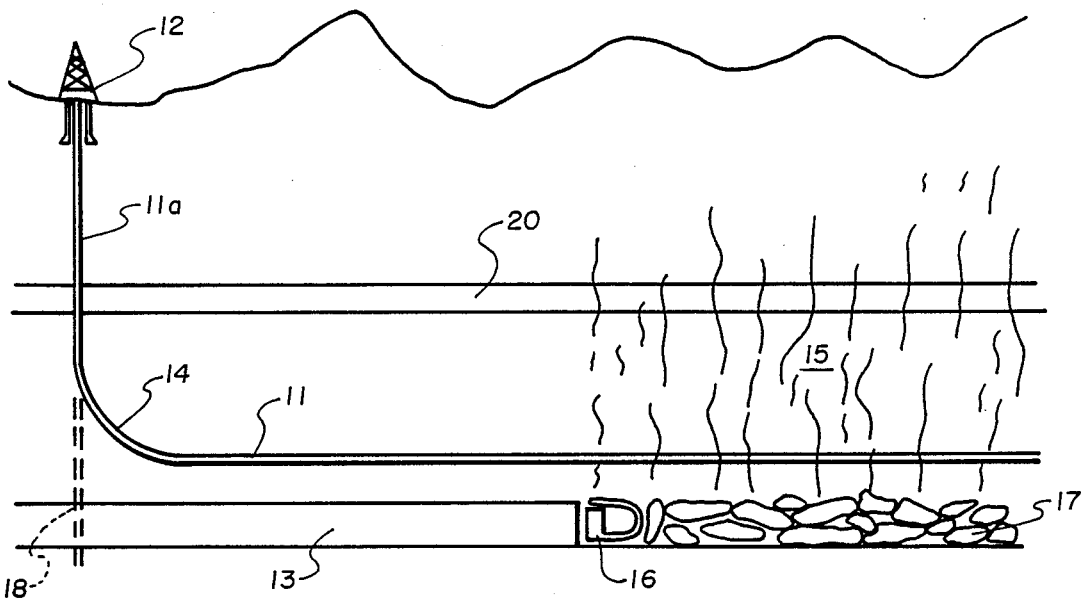
FIG. 1 is a side elevation schematic view illustrating a practice of the present invention of directionally drilling, from a surface location, a degas hole that is curved to extend approximately parallel, near parallel or slanted and is spaced above a coal seam being longwall mined.

FIG. 1 illustrates a formation of a single degas hole 11 that is drilled from a surface location, shown as a tower 12. A first or vertical degas hole section, shown at 11*a*, is drilled to above a coal seam 13 that will be or is being longwall mined. Thereat, the hole is turned or bent, as shown at 14, through up to ninety (90) degrees to essentially parallel, near parallel or slanted and spaced apart a certain distance above that coal seam. Preferably, the degas hole 11 is formed by directional drilling techniques and with directional drilling apparatus that are well known in the art, are in common use, and accordingly will not be set out in detail herein.

The degas hole 11, formed by conventional drilling methods, is turned, as shown at 14. Such turning, for example, may be through a very short radius of a few feet, a short radius of thirty five (35) feet, a medium radius, or through greater radius of three hundred fifty (350) feet or greater, depending on the drilling conditions, techniques and apparatus employed. After turning, the degas hole 11 extends above and is essentially parallel, near parallel or slanted to the coal seam 13, and is spaced a distance above that seam that is selected for the particular roof rock strata 15 composition. It is believed that a spacing distance of from twenty (20) to two hundred (200) feet is appropriate for rock strata as is usually found with methane containing coal seams.

Figure 4:
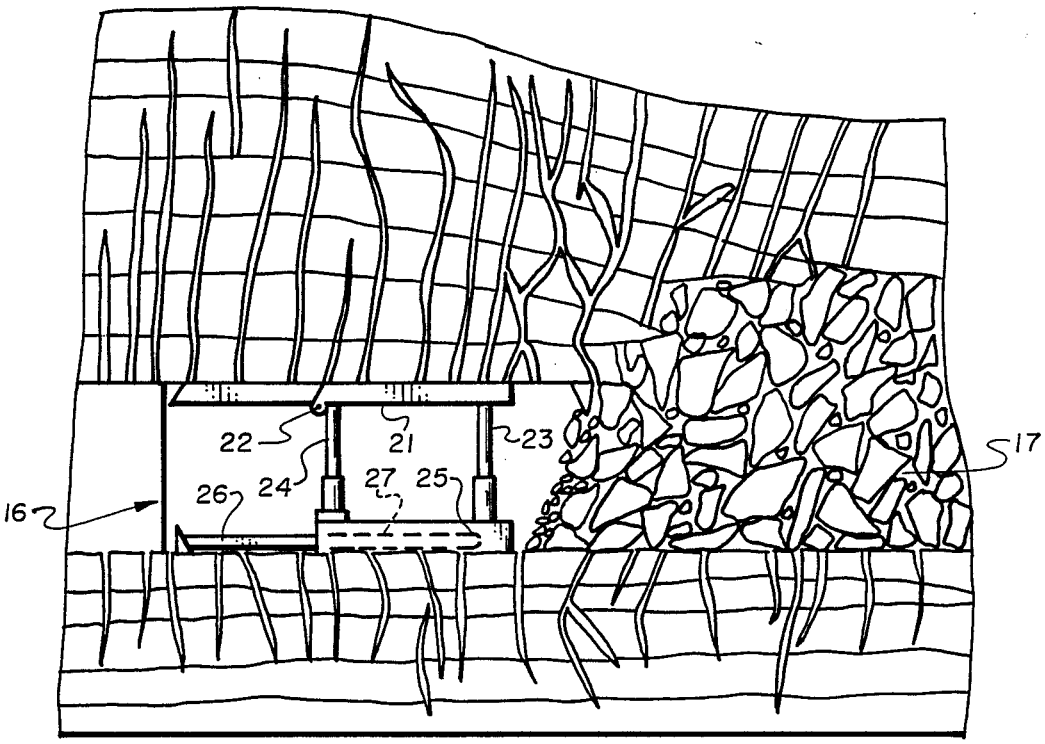
FIG. 4 is a detailed side elevation schematic view of a longwall mining face containing a coal seam with roof support equipment therein for practicing longwall mining.

The present process is appropriate for practice on active conventional, room and pillar mining and longwall mining operations as well as inactive abandoned mines, where a coal seam has been removed and subsequently causes the mine roof to cave and fracture into the opening behind the mining process. The collapsed roof creates the gob that releases methane gas, which gas flows, under pressure differential, through the degas hole 11 to the surface for pipe line transport, or the like, and/or use. FIG. 4 shows a schematic of a mine ceiling support apparatus 16 that is arranged to be tilted from a supporting attitude, letting the mine roof collapse into the mined out area, creating a gob 17.

FIG. 1 illustrates fractures with wavy vertical lines extending upwardly from gob 17 that are created, as a result of roof collapse. The fractures create the pathway for methane released from the coal and adjacent strata with gas therefrom to flow under vacuum or pressure differential through the degas hole 11 to the surface. Of course, as the mine ceiling collapses the rubbling and shifting of strata as occurs may close off a portion of the degas holes, particularly the section of the hole that is above the gob area. However, with proper spacing of the degas hole 11 above the coal seam 13, such partial closure should not curtail flow at the degas hole end portion that is adjacent to the active mining face. Whereas, when mining is far past a conventional vertical gob ventilation hole, gas flow has been found to terminate or will at least be significantly restricted. A vertical degas well, as shown in broken lines at 18, may be preferably included as an extension of the first or vertical degas hole section 11*a*, through the turn 14. This degas well section 18 may or may not be artificially stimulated and is provided for degasification in advance of mining. Such degas hole will experience a change in productivity when mining approaches or passes thereunder.

Figure 2:
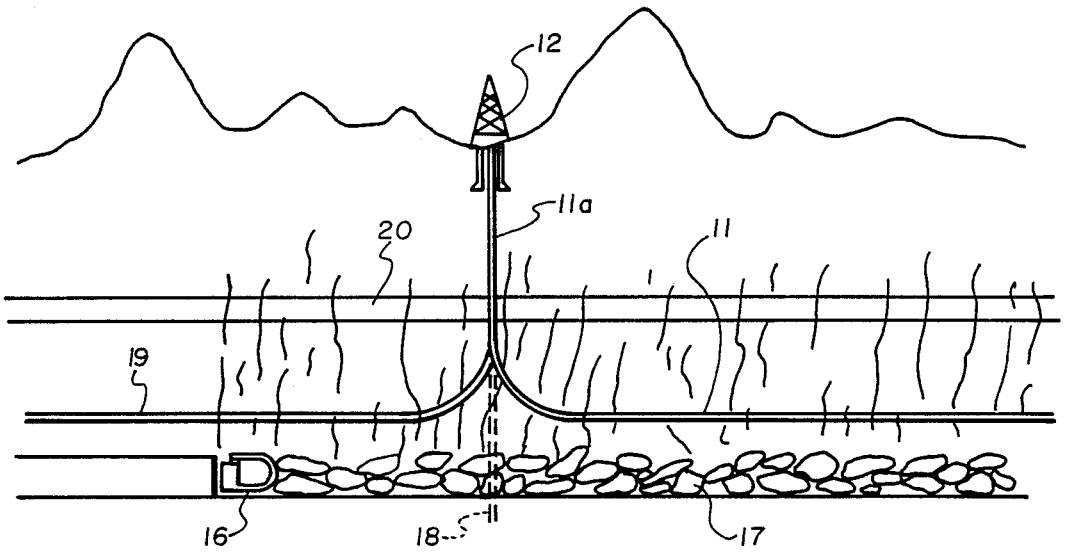
FIG. 2 is a side elevation schematic view that is like FIG. 1, except it shows a pair of degas holes drilled from a single vertical well bore that are curved oppositely, and are spaced from a coal seam being longwall mined.

FIG. 2 shows a side elevation view that is like FIG. 1, but further shows a second degas hole 19 as having been drilled from the tower 12. Which hole 19 is directed oppositely from turn 14 to extend as a reciprocal to the horizontal portion of degas hole 11, and is likewise spaced above the coal seam. Shown therein, the gob 17 extends beyond the degas well 18, with mining continuing away from that well and degas hole section 11*a*. Of course, with mining proceeding from and away from degas hole section 11*a*, the degas hole 19 may become restricted necessitating drilling a degas hole from another surface location. Like FIG. 1, fractures are shown in FIG. 2 as extending from the coal seam and rock strata above and into a second coal seam 20. Coal seam 20 may be mined out or unworked, and is included to show that, with the present process, methane gas can be collected from the coal seam being mined, the rock strata above, and even from coal seams above and alongside. Which collection can involve pulling the gas under vacuum to the surface, or can utilize the pressure that the gas is under at its release where that pressure is greater than atmospheric.

It is, of course, the case that coal is often mined from side by side coal seams. In such mining activity, from the single tower 12, degas holes can be curved into alignment with a number of coal seams, with the holes individually curved to extend thereover and spaced appropriately above each coal seam to be mined. Further, while not shown, it should be understood that, additional to drilling one or more degas holes that are spaced apart and extend longitudinally to a coal seam, to increase methane gas collection, one or more degas holes could be drilled across or at an angle to a coal seam or seams. Accordingly, it should be understood, the present invention is practiced by drilling one or more degas holes from a surface location to curve above a coal seam to be mined, each hole to extend parallel, near parallel or slanted thereto at a desired spacing distance thereabove. With a practice of the present process, an optimum or most convenient surface location or locations can be chosen for drilling so as to minimize drill distance. This provides a most economical system of methane gas recovery.

Figure 3:
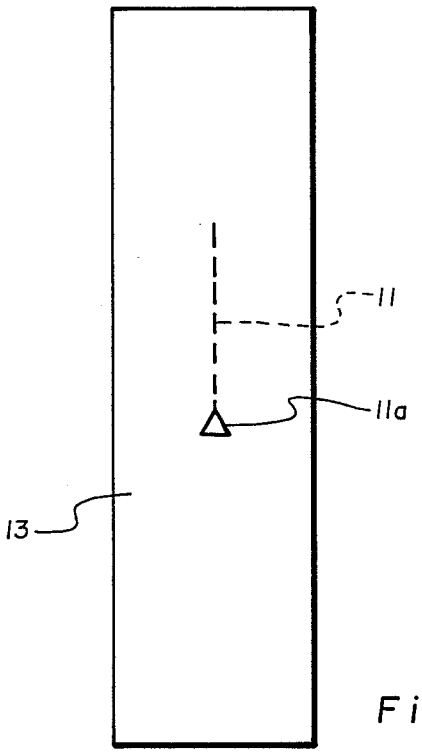
FIG. 3 is a top plan schematic of a coal seam showing, as a triangle, a vertical well bore with a degas hole that is shown in broken lines, extending along the center longitudinal axis of a coal seam.

FIG. 3 illustrates a top plan schematic of the coal seam 13 of FIG. 1, showing the vertical portion 11*a* of degas hole 11 as a triangle, with the horizontal portion of the degas hole shown as a broken line. In practice, it is believed that a degas hole 11 up to two thousand five hundred (2,500) feet in length and greater could be formed for recovering methane gas. In such drilling, the degas hole length is dependent upon the rock strata conditions and the condition of the degas hole. Which degas hole, depending upon depth and rock strata conditions can be cased with slots or perforations or uncased within the scope of this disclosure.

FIG. 4 is included to illustrate a type of mine roof support apparatus 16 that is commonly used in longwall mining. Such apparatus provides a tilt bed 21 that can be pivoted around a pivot 22 by extension or withdrawal of pistons 23. In operation, the tilt bed end, or furthest edge is lowered, allowing for the collapse of the mine ceiling behind the roof support, creating the gob 17. In such collapse, piston 24 remains extended, with the fractured mine roof directed behind the slanted tilt bed, urging a platform 25 of the apparatus back along rails 26 that slide into guides 27, shown in broken lines. So operated, the apparatus 16 is repositioned back from the gob 17, in supporting arrangement to the mine ceiling.

Hereinabove has been set out preferred practice of the procedure or process of the present invention for a gob methane drainage system. It should, however, be understood that the present disclosure is made by way of example only and that the process set out herein may be varied without departing from the subject matter coming within the scope of the following claims, and any reasonable equivalency thereof, which claims we regard as our invention.

What is claimed is:

1. A gob methane drainage process comprising, from a surface location that is above and intermediate to the longitudinal axis of a coal seam to be mined or has been previously mined, drilling from a single platform at least one vertical degas hole to above said coal seam to be mined or has been previously mined and curving drilling oppositely from said vertical degas hole into a plurality of degas holes that each extend above, essentially parallel, near parallel or slanted to, and are spaced appropriately apart from the area of the coal seam to be mined or has been previously mined; and removing methane gas through the degas holes to the surface as is produced during and after mining of the coal seam area that is below or adjacent to each said degas hole.

2. A gob methane drainage process as recited in claim 1, wherein each degas hole is spaced apart from the top of the coal seam to be mined or as has previously been mined at a distance of from twenty to two hundred feet vertical distance.

3. A gob methane drainage process as recited in claim 1, wherein each degas hole is cased and the casing is slotted or perforated.

4. A gob methane drainage process as recited in claim 1, wherein each degas hole is approximately aligned with the coal seam center longitudinal axis.

5. A gob methane drainage process as recited in claim 1 wherein each portion of the degas hole above the coal seam extends for approximately one thousand to two thousand five hundred feet parallel, near parallel or slanted to that coal seam.

6. A gob methane drainage process as recited in claim 1, further including, continuing the vertical degas well vertically beyond where the degas holes are turned to extend into the coal seam as an extension of said vertical degas hole.

* * * * *